United States Patent [19]

Kedzierski

[11] Patent Number: 4,911,334

[45] Date of Patent: Mar. 27, 1990

[54] BEVERAGE DISPENSER

[76] Inventor: Piotr Kedzierski, 300 N. 10th, Centerville, Iowa 52544

[21] Appl. No.: 215,509

[22] Filed: Jul. 6, 1988

[51] Int. Cl.[4] ..... B67D 3/00; B67D 5/06

[52] U.S. Cl. ..... 222/185; 222/465.1; 222/481; 222/484; 222/518

[58] Field of Search ..... 222/131, 183–185, 222/518, 465.1, 484, 481.5; 137/588; 220/85 H, 3.1; 16/110.5, 125; 294/168, 137

[56] References Cited

U.S. PATENT DOCUMENTS

| | | | |
|---|---|---|---|
| 2,255,280 | 9/1941 | Colvin | 222/131 |
| 2,270,383 | 1/1942 | Norton et al. | 222/131 |
| 3,265,250 | 8/1966 | Meyer | 222/131 |
| 3,933,275 | 1/1976 | Metzner et al. | 222/131 |
| 4,505,408 | 3/1985 | Sagol | 222/131 |
| 4,664,297 | 5/1987 | Giovinazzi | 222/481.5 |
| 4,715,516 | 12/1987 | Salvail | 222/185 |
| 4,722,463 | 2/1988 | Anderson | 222/185 |

*Primary Examiner*—H. Grant Skaggs
*Assistant Examiner*—Steve Reiss

[57] ABSTRACT

This is provided a beverage dispenser for dispensing carbonated beverages from bottled beverages. The dispenser comprises a bottle holder for holding bottles in an iverted position and a dispensing valve which screws onto each bottle neck in place of its standard cap closure. The dispensing valve has two passages: a vent passage to decompress the beverage in the bottle just before its discharging of the beverage and the second a discharging passage for the discharging of beverage therefrom. The passages are closed by the insertion of plungers into each of the passages far enough to seal the passages. The plungers are attached to a slide so as to simultaneously move the plungers together. The outside edges of the passages are offset so as to permit, during the opening stroke, the vent passage to open first. The slide and its attached plungers are pushed to close or pulled to open the passages by a hand operated lever which rotates around a fulcrum point under finger pressure. In the closed position the force from pressure inside the bottle against plungers is transferred onto the lever so as to maintain the lever in the closed position. The bottle holder is suitably equipped with lid for insulation and a handle extending through the lid to carry the beverage dispenser with the dispensing bottles inside.

4 Claims, 3 Drawing Sheets

BEVERAGE DISPENSER

TECHNICAL FIELD

This invention relates to dispensing devices for carbonated beverages, valves and beverage coolers.

BACKGROUND ART

Carbonated beverages are sold in plastic bottles of a one, two or three liter volume capacity. The beverages are usually served straight from the bottle which often leads to decarbonation and warming of the beverage. Spring cap closures are also on the market to keep an open bottle closed. Another conventional manner for serving carbonated beverages is to dispense the beverages from a standard beverage dispenser under dispensing conditions which leads to decarbonation of the beverage.

SUMMARY OF THE INVENTION

The invention provides for a beverage dispenser for dispensing carbonated beverages from bottled beverages. The dispenser comprises a bottle holder for holding bottle in an inverted position and a dispensing valve which screws onto each bottle neck in place of its standard cap closure. The dispensing valve has two passages: a vent passage to decompress the beverage in the bottle just before its discharging of the beverage and the second a discharging passage for the discharging of beverage therefrom. The passages are closed by the insertion of plungers into each of the passages far enough to seal the passages. The plungers are attached to a slide which simultaneously moves the plungers together. The outside edges of the passages are offset from one another so as to permit, during the opening stroke, the vent passage to open first. The slide and its attached plungers are pushed to close or pulled to open the passages by a hand operated lever which rotates around a fulcrum point under finger pressure. In the closed position, the force from gas pressure inside the bottle against the plungers is transferred onto the lever so as to maintain the lever in the closed position. The present invention alleviates many of problems associated with the serving of beverages from large volume bottles by providing the following beneficial functions:

1. permitting carbonated beverages to be served from the original bottle in a smooth and uniform stream, while limiting foaming without splashing and exploding of the dispensed beverage;
2. maintaining the bottled beverage in a carbonated and cooled condition;
3. simplifying the dispensing of the bottled beverage into an easy operation, even for children because of a unique, spring-free dispensing valve; and
4. providing a dispenser with room for ice between the dispensing bottles to cool the bottled beverages.

DESCRIPTION OF THE PREFERRED EMBODIMENTS

Figure 1:
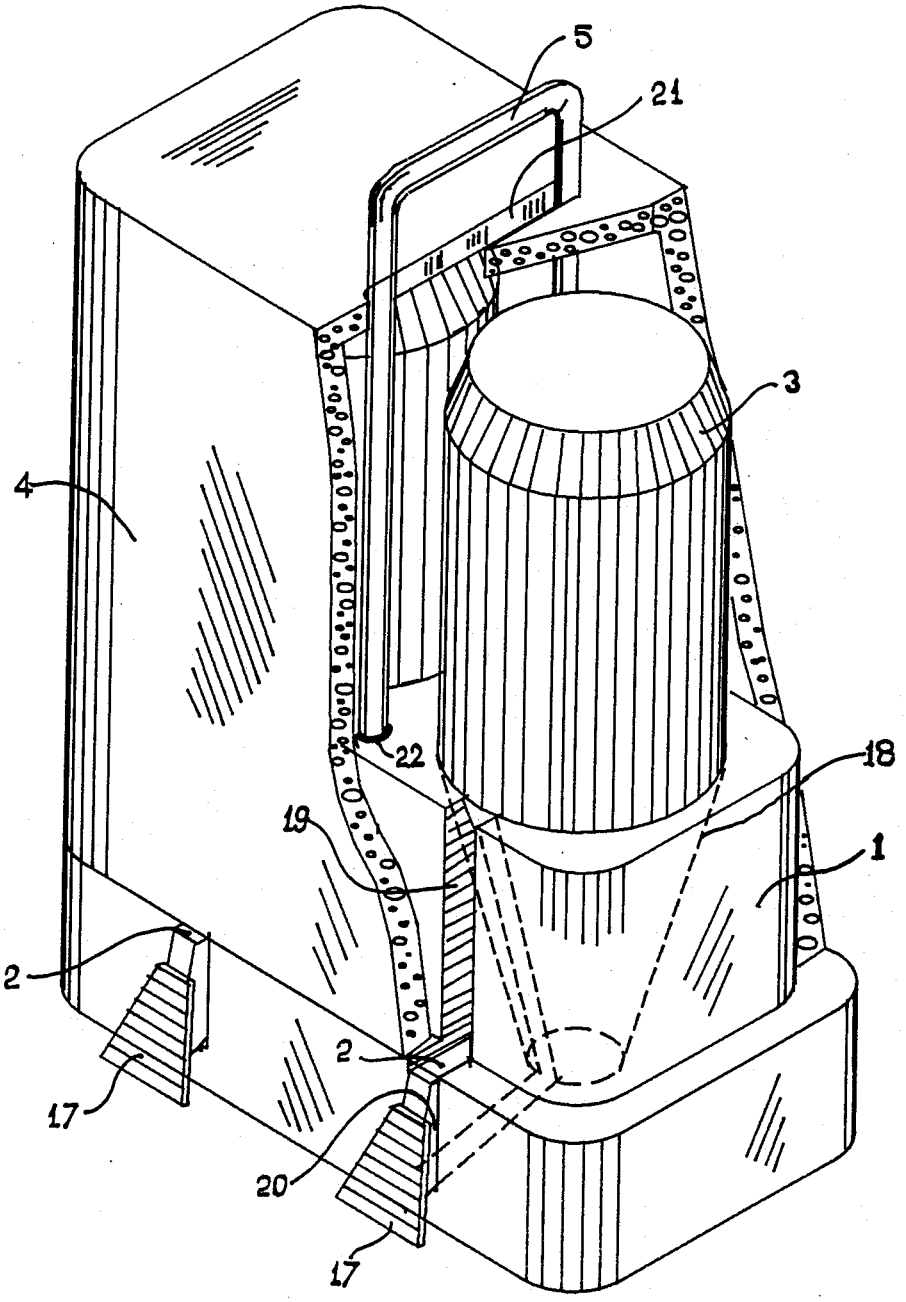
FIG. 1 is a general view of the dispenser.

The dispenser of this invention is suitably adapted to directly dispense carbonated beverages from high volume plastic bottles such as those of a 1 to 3 liter capacity. The beverage dispenser, as further illustrated in the drawings, includes a bottle holder (1) or base for holding each dispensing bottle in the inverted position, a dispensing valve (2), an insulated lid (4) and a handle (5) to carry the dispenser.

FIG. 1 shows a general view of the dispenser. Holder (1), made preferably of a foamed plastic, has a cavity (18) for holding each bottle (3) in an inverted position. The holder (1) is equipped with a vertical slot (19) to provide room for a spout (20) of the dispensing valve (2). Although two such cavities for holding the two inverted bottles are illustrated in the FIG. 1, any other number cavities are possible.

Holder (1) and bottles (3) are covered with lid (4) which fits onto holder (1) and is also preferably of a foamed plastic construction. Each bottle held within dispenser is fitted with a dispensing valve (2) which screws or threads onto the standardized bottle neck threads for the bottle cap. The lid (4) has a slot (21) to make room for a handle (5). Handle (5) is a U-shaped injection molded plastic piece which projects upwardly from the holder (1).

Dispensing valve (2) has a spout (20) which extends through a slot (19) of holder (1) and beyond the walls of the lid (3) and holder (1). The dispensing valve (2) is equipped with a lever (17) operated by hand which opens the valve when lever (17) is raised upwardly.

Figure 2:
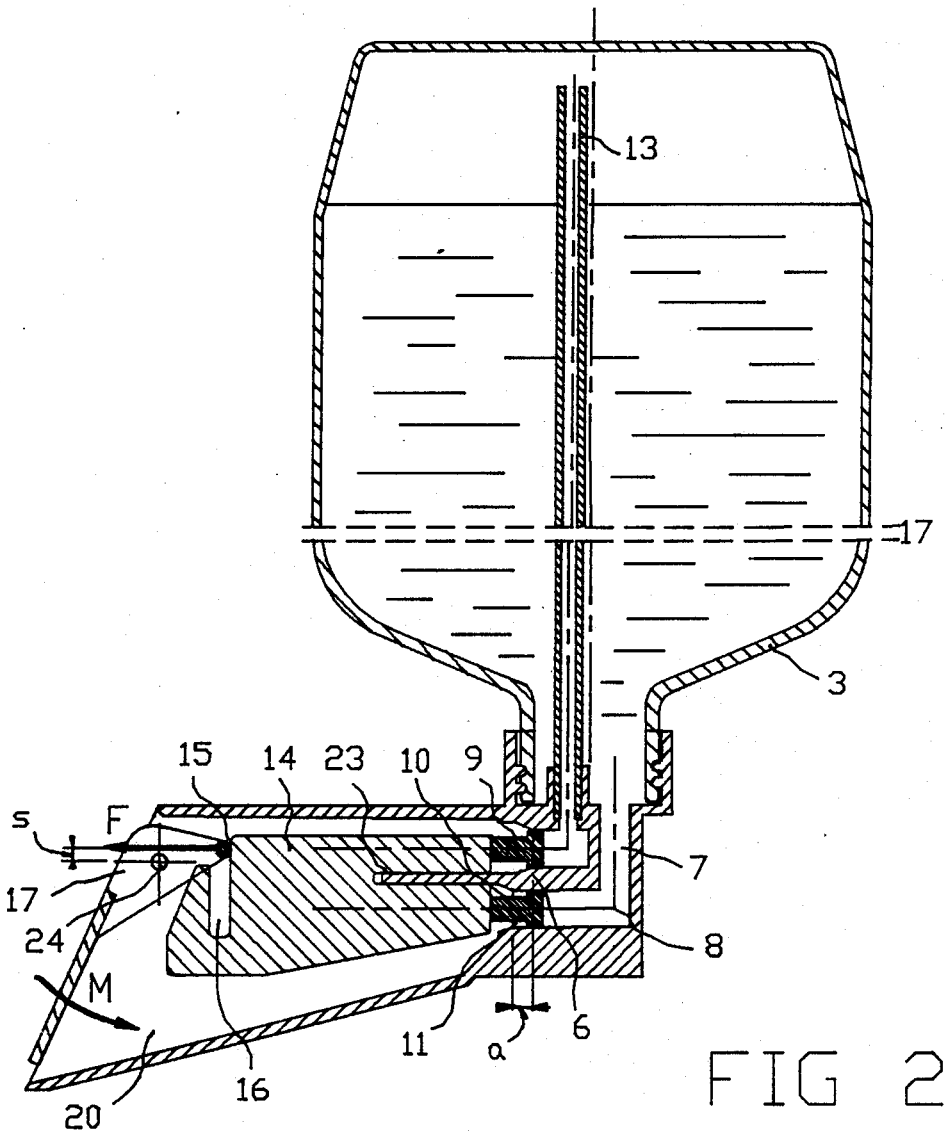
FIG. 2 is a sectional view of the bottle dispensing valve in the closed position.
Figure 3:
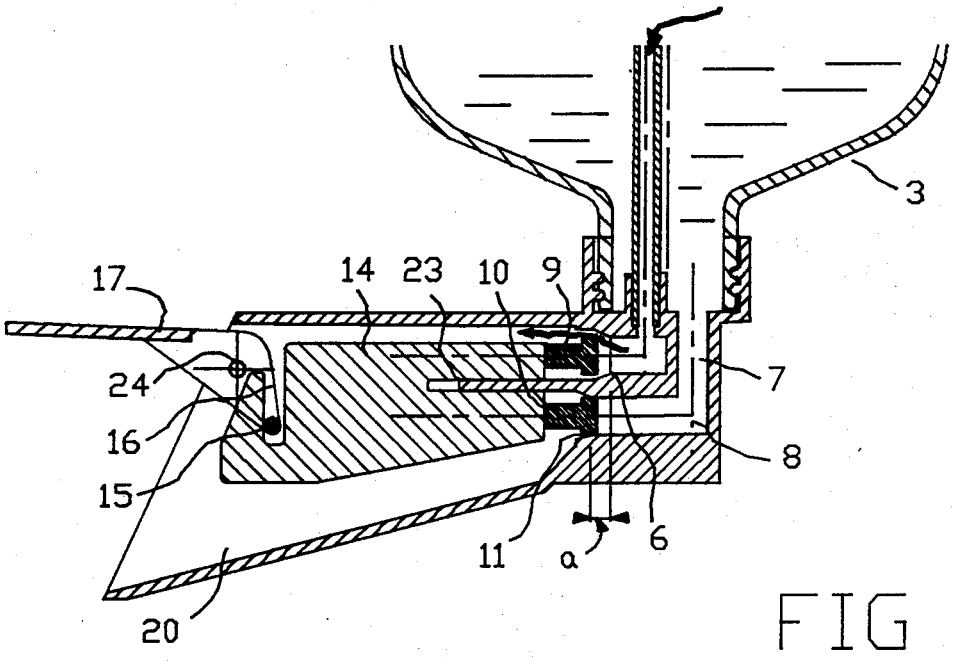
FIG. 3 is a sectional view showing the dispensing valve in partially open position with the vent passage open and the discharge passage closed.
Figure 4:
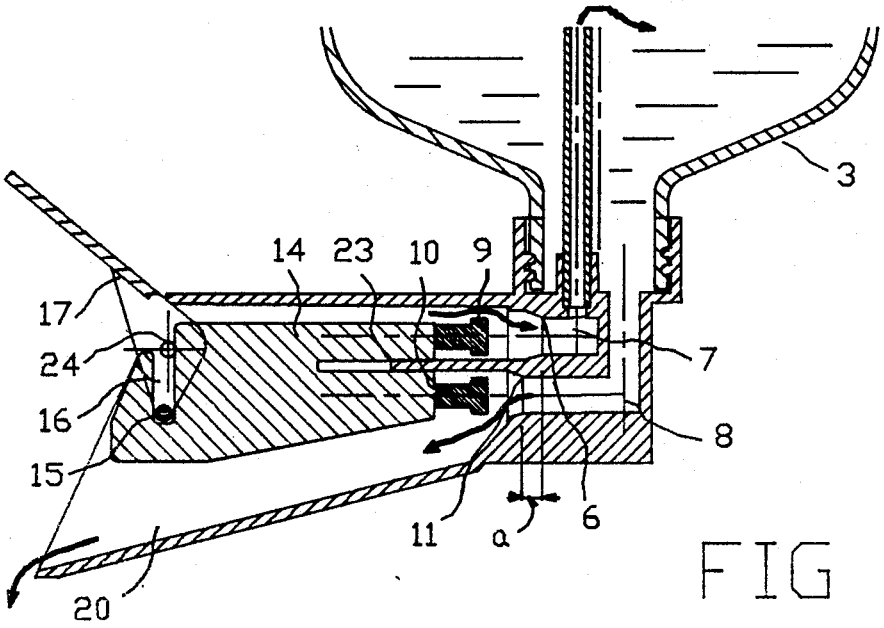
FIG. 4 is a sectional view of the dispensing valve in the fully opened position.

In reference to FIGS. 2–4, the dispensing valve (2) serves to release compressed gas above the surface of the beverage just before the discharging of beverage from the dispenser which in turn permits the beverage to be dispensed therefrom in a smooth and uniform stream. The dispensing valve (2) is equipped with two passages one which is a vent passage (7) for decompressing pressure from the bottle (3) and for allowing air to enter the bottle during the discharging of beverage therefrom, and the other passage being a discharge passage (8) for the discharging of beverage from the dispensing bottle. In the closed position, passages (7) and (8) and are closed by plungers (9) and (10) which respectively enter into passages (7) and (8) far enough to close passages (7) and (8). Plungers (9) and (10) are attached to slide (14) which allows plungers (9) and (10) to move together. The outside edge (6) of vent passage (7) is located at an offset position in relationship to the outside edge (11) of discharge passage (8) which offset position is referenced by the letter "a" in FIGS. 2–4. This offsetting positioning (a) allows plunger (9) in the opening stroke to be first withdrawn from vent passage (7) which allows the pressurized gas to escape from the bottle through the hose (13) and vent passage (7) as shown in FIG. 3. In the open position as shown in FIG. 4, vent passage (7) allows air to enter the bottle and thereby avoid gurgling of the dispensed beverage. A similar function can also be achieved by placing plungers (9) and (10) (instead of the passages) in an offset relationship to one another.

FIG. 2 more specifically shows dispensing valve (2) in the closed position. Both plungers (9) and (10) are shown as being positioned inside of passages (7) and (8). Plungers (9) and (10) are attached to slide (14) which moves along guide (23) the latter of which is a part of the valve body. When slide (14) is pushed in, as shown in FIG. 2 it is maintained in place by a stud (15). Stud (15) is a part of lever (17). Lever (17) pivots about center point (24). The positioning of center point (24) is such that in the closed position, stud (15) of lever (17) will rest above center point (24) at a distance (designated as "s" in FIG. 2) so that the vector of force (designated as (F)) of internal pressure against plungers (9) and (10) and the attached stud (15) creates a momentum (shown as (M)) which maintains the lever (17) in the closed position.

FIG. 3 depicts the configuration of dispensing valve (2) elements during the first stage of the opening stroke. To open the valve the operator rises the lever (17). Lever (17) then rotates around center point (24); causing stud (15) to move into slot (16) which in turn pulls upon slide (14) and the attached plungers (9) and (10). The outer edge (6) of passage (7) is placed in an offset relationship to the outer edge (11) of passage (8) which offsetting relationship is referenced in FIGS. 2–4 as "a". In the positioning of lever (17) as shown in FIG. 3, slide (14) is positioned so that plunger (9) has been withdrawn from the outer edge (6) of vent passage (7) while plunger (10) is shown as being positioned within discharge passage (8). In the illustrated opening stroke of FIG. 3, passage (7) is thus open while passage (8) remains closed. This permits compressed gas within the dispensing bottle to escape through hose (13) and the opened passage (7).

FIG. 4 shows the configuration of valve elements in the fully opened position. Both plungers (9) and (10) are shown as being withdrawn from passages (7) and (8). Beverage may accordingly discharge from the bottle (3) through passage (10). Air may also enter into the bottle (3) through passage (7) and hose (13). The separating wall (23) between passages (7) and (8) protect the vent passage (7) from blocking by foaming within discharge passage (8).

I claim:

1. A beverage dispenser for dispensing beverage from high volume bottles comprising:

(a) a bottle holder having separate cavities for each bottle to keep said bottle in an inverted position;

(b) a removable cover made preferably with insulated material comprising vertical walls and top; and (c) a dispensing valve attached sealingly to each bottle in place of a standard threaded closure having:

(i) a body with a threaded portion to attach to a threaded neck of the bottle;

(ii) two passages made in said body, one to communicate with the liquid, the second to communicate with the gas above the surface of liquid, (iii) one closure assembly having: two rigidly attached plungers placed in the manner that said plungers correspond with said passages, (iv) a hand operated lever pivotally mounted to said body, said lever being connected with a slide assembly through a pin formed in said lever and being placed in a slot in the closure assembly recited in (iii).

2. A beverage dispenser as cited in claim 1 having a U-shaped rigid handle to carry said dispenser, said handle being attached to said bottle holder in a location between the two bottles, said handle projecting through a slot in the top of said removable cover.

3. A two way dispensing valve for dispensing a carbonated liquid from a bottle with threaded neck placed in a verticle position comprising:

(a) one closure assembly having two rigidly attached plungers and a slot cut perpendicularly to the direction of the movement of said slide assembly; and (b) body having:

(i) a threaded portion to attach to the threaded neck of the bottle, (ii) one housing for the slide assembly, said housing being also a spout, (iii) two passages made in said body: a discharge passage to communicate with the liquid, and a vent passage to communicate with the gas above the surface of liquid, said gas passage having an outlet edge placed in such manner in reference to an outlet edge of said discharge passage that in a certain position of said slide assembly, one said plunger is inserted sealingly in said discarge passage when second said plunger is placed out of said gas passage;

(c) a hand lever pivotally mounted to said body, said lever being connected with said slide assembly through a pin formed in said lever and being placed in the slot recited in (a), said lever being pivotally mounted to said body in such place of said body that in rest position of said lever, force of liquid pressure exerted at said lever through said plangers create momentum supporting said lever in said rest position.

4. A dispensing valve recited in claim 3 having a separating wall placed between said air passage and said discharge passage projecting into said housing to protect said air passage against foam spreading from the discharge passage.

* * * * *